US006164236A

United States Patent [19]

Liu

[11] Patent Number: 6,164,236

[45] Date of Patent: Dec. 26, 2000

[54] DEVICE FOR JETTISONING AN OBJECT INTO THE WATER FROM A VESSEL

[75] Inventor: Ruey-Shan Liu, Kaohsiung, Taiwan

[73] Assignee: Chung-Shan Institute of Science and Technology, Taoyuan Hsien, Taiwan

[21] Appl. No.: 09/273,977

[22] Filed: Mar. 22, 1999

[51] Int. Cl.[7] ..... B63B 8/00

[52] U.S. Cl. ..... 114/343; 114/375

[58] Field of Search ..... 114/18, 258, 362, 114/366, 375, 382, 210, 343; 102/411

[56] References Cited

U.S. PATENT DOCUMENTS

| | | | |
|---|---|---|---|
| 3,363,269 | 1/1968 | Kossuth | 5/83.1 |
| 4,079,901 | 3/1978 | Mayhew et al. | 244/63 |
| 4,286,346 | 9/1981 | Wiek | 114/344 |
| 4,294,331 | 10/1981 | Reynoir et al. | 182/10 |
| 4,395,185 | 7/1983 | Whaley | 414/483 |
| 4,683,832 | 8/1987 | Dysarz | 114/258 |
| 5,184,913 | 2/1993 | Meriwether | 405/1 |
| 5,427,557 | 6/1995 | Lunden, Sr. | 441/82 |
| 5,624,292 | 4/1997 | Wiseman, Jr. | 441/80 |
| 5,706,755 | 1/1998 | O'Brien | 114/365 |
| 5,829,380 | 11/1998 | Smith | 114/362 |
| 5,884,824 | 3/1999 | Spring, Jr. | 224/310 |

*Primary Examiner*—S. Joseph Morano
*Assistant Examiner*—Ajay Vasudeva
*Attorney, Agent, or Firm*—Bacon & Thomas, PLLC

[57] ABSTRACT

A device for jettisoning an object into the water from a vessel has a body having a pair of parallel straight tracks each provided with a pivot seat and connection plate respectively mounted on opposite ends thereof, a locking assembly having an axle pivotally connected between one of the connection plates and one of the parallel straight tracks and two opposed locks securely mounted on different ends of the axle and a set of moving tracks pivotally connected with the pair of straight tracks of the body and having a pair of opposed ears respectively formed on the under side of each of the set of the moving tracks. With this arrangement, the cart is able to be safely moved before the device of the invention, and after deactivation of the locks on the moving tracks, the push cart with the object carried thereon is then smoothly moved to a position ready for jettisoning an object into the water.

8 Claims, 7 Drawing Sheets

DEVICE FOR JETTISONING AN OBJECT INTO THE WATER FROM A VESSEL

BACKGROUND OF THE INVENTION

1. Field of the Invention

The present invention relates to a device for jettisoning an object into the water from a vessel, and more particularly to a device whose jettisoning angle with respect to the surface is adjustable and can be combined directly with conventional tracks to reduce cost.

2. Description of Related Art

A conventional device for jettisoning an object into the water from sea vessel has a plurality of tracks (40) arranged in an array such that a cart (50) carrying objects (51) thereon is able to move freely on the tracks (40) as shown in FIG. 6. To facilitate jettisoning objects into the water, the end (42) of the track (40) is further connected to a pair of arcuate tracks (60), as shown in FIG. 7. Therefore, objects (51) carried by the cart (50) can be smoothly jettisoned onto the water surface. However, with such an arrangement, due to the design of the arcuate track (60), the jettisoning angle of the objects (51) onto the water surface is fixed. Objects (51), regardless of their size and weight differences, will have only one jettisoning angle, which easily causes collision of the objects with the sides of the vessel. Furthermore, the arcuate track (60) limits the size and shape of the objects (51).

From the above description, an improvement to the conventional device for jettisoning an object into the water from a vessel is necessary so as to obviate and/or mitigate the aforementioned problems.

SUMMARY OF THE INVENTION

The primary objective of the present invention is to provide a device for jettisoning an object into water from a vessel. The jettisoning angle of the device for the object to be jettisoned into the water is adjustable so that users are able to freely choose the size and shape of the object.

Another object of the invention is to provide a pair of second tracks pivotally connected to a pair of straight first tracks, such that when the cart is moved to the second tracks, the pivotal movement of the second tracks will facilitate the jettisoning of the object into the water. Furthermore, a locking assembly is provided to ensure the safety of the device in accordance with the invention. The locking assembly is able to selectively secure the second tracks, and a lock thereof is able to stop the cart before the push cart is moved onto the second tracks.

Still, another object of the invention is to provide a knob pivotally mounted to the device. The knob can be pivoted to activate the locking and unlocking of the lock to the second tracks so as to proceed with the jettisoning of the object into the water.

In accordance with one aspect of the present invention, the device comprises a body having a pair of parallel straight tracks each provided with a pivot seat and connection plate respectively mounted on opposite ends thereof, a locking assembly having an axle rotationally connected between one of the connection plate and one of the opposed straight tracks and two opposed locks securely mounted on different ends of the axle and a set of moving tracks pivotally connected with the pair of straight tracks of the body and having a pair of opposed ears respectively formed on the under side of each of the set of the moving tracks. With this arrangement, the cart is able to be safely moved before the device of the invention, and after deactivation of the lock to the moving tracks, the cart with the objects carried thereon is then smoothly moved to a position ready for jettisoning the object into the water.

A further object of the invention is to provide an adjusting screw at the end of the straight tracks, such that when the moving tracks pivot with respect to the straight tracks, the bottom face of the moving tracks will abut the adjusting screw. With the adjustment of the adjusting screw into or away from the end of the straight tracks, the jettisoning angle of the object into the water is changeable.

Further objectives and advantages of the present invention will become apparent from a careful reading of the detailed description provided hereinafter, with appropriate reference to the accompanying drawings.

DETAILED DESCRIPTION OF THE PREFERRED EMBODIMENTS

Figure 1:
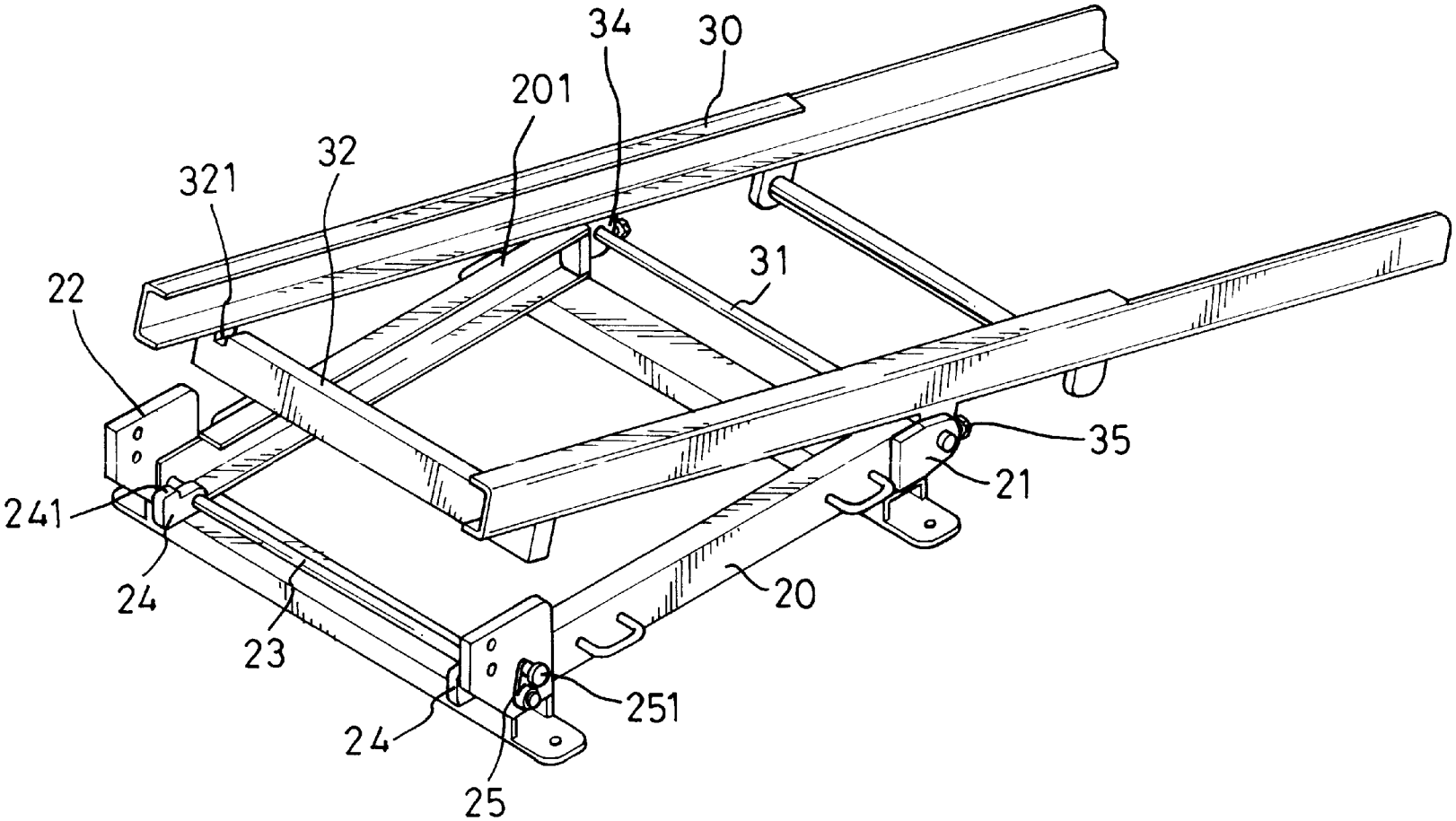
FIG. 1 is a perspective view showing the device for jettisoning an object into the water from a vessel in accordance with the invention.

Referring to FIG. 1, a device for jettisoning an object into the water from a vessel comprises a body (20) having a pair of parallel straight tracks (201) each provided with a pivot seat (21) and a connection plate (22) respectively mounted on opposite ends thereof, a locking assembly having an axle (23) rotatably connected between one of the connection plates (22) and one of the opposed straight tracks (201) and at least one lock (24) (two are shown in the preferred embodiment of the invention) securely mounted on the axle (23) and having a stepped face (241) peripherallyformed thereon and a pair of moving tracks (30) pivotally connected with the pair of straight tracks (201) of the body (20) and having a pair of opposed ears (34) respectively formed on an under side of each of the moving tracks (30) and pivotally connected with the corresponding pivot seat (21) of the body (20) by a pin (31). The pair of moving tracks (30) further has a weight (32) securely mounted near the inside ends thereof and between the tracks (30). The weight (32) has at least one cutout (321) (two are shown in the preferred embodiment of the invention) defined to correspond to the stepped face (241) of the lock (24) on the axis (23).

Figure 2:
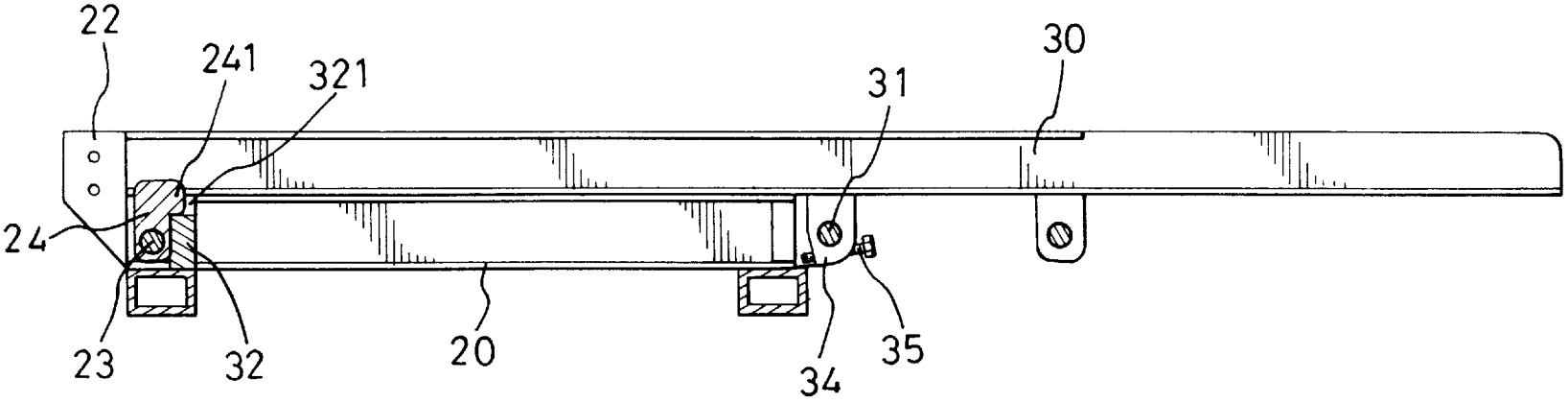
FIG. 2 is a side plan view showing that a pair of straight tracks are connected with a pair of moving tracks in accordance with the invention.
Figure 3:
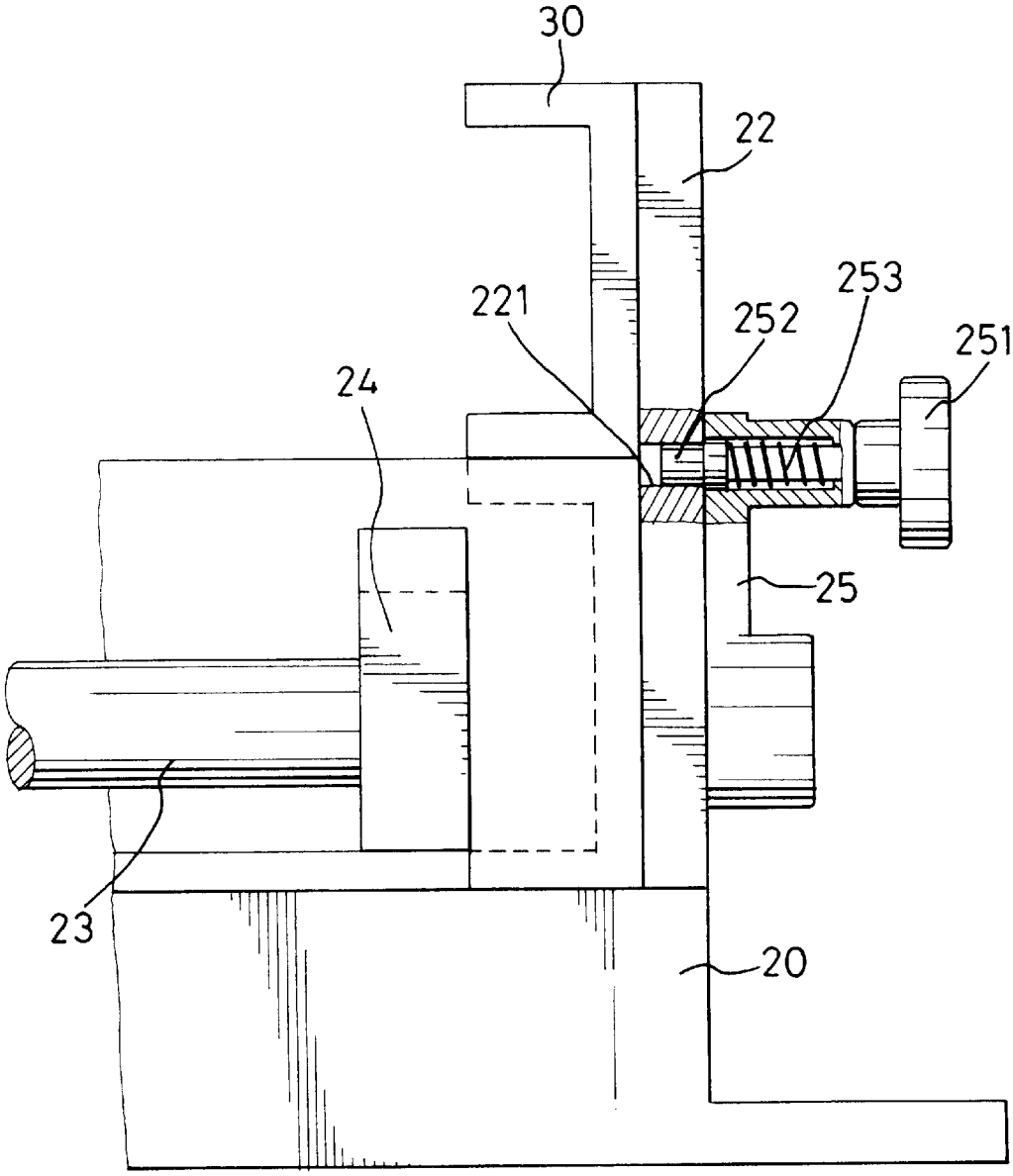
FIG. 3 is a partially enlarged view of the locking assembly in accordance with the invention.
Figure 4:
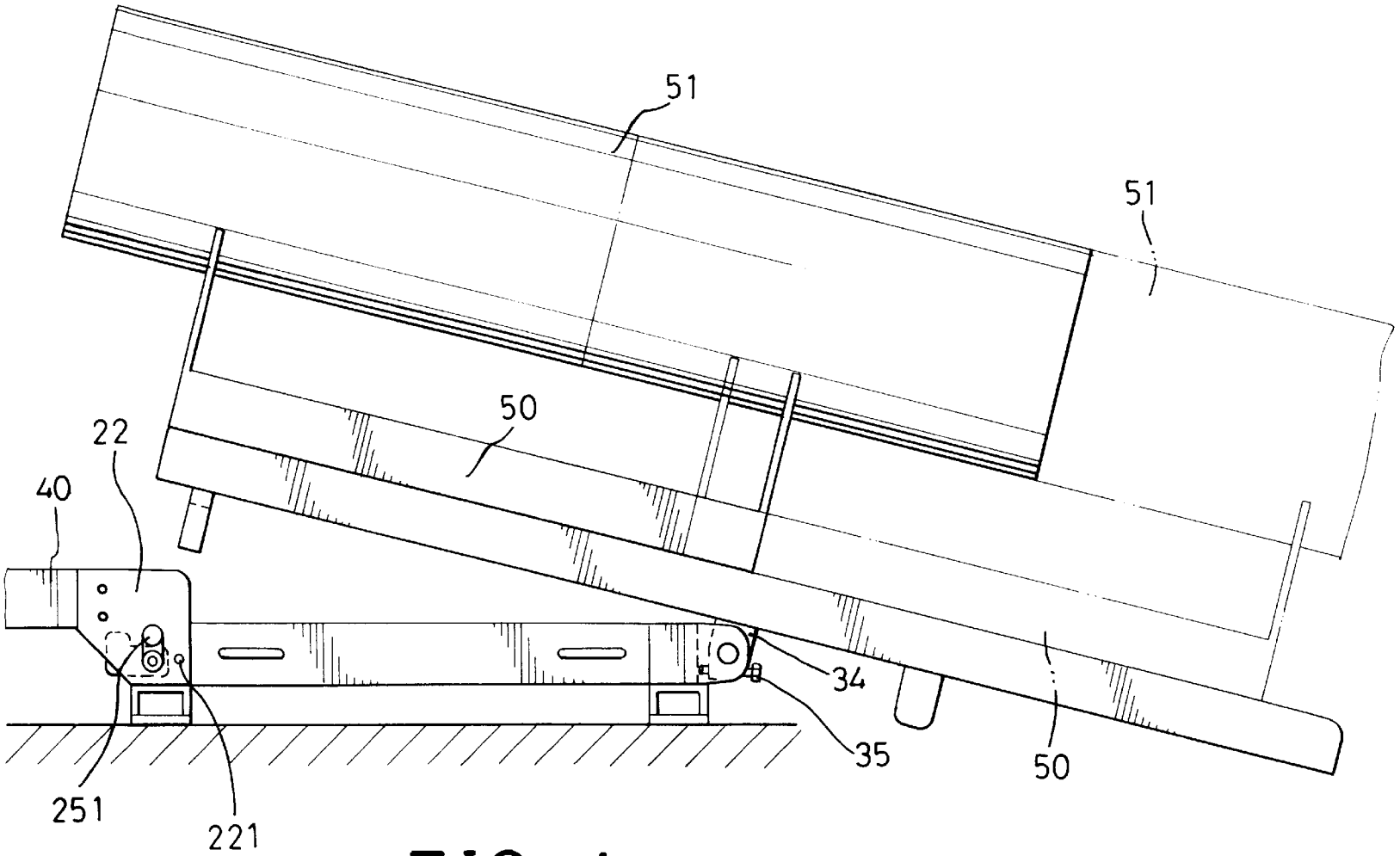
FIG. 4 is a schematic view showing the moving tracks released from the straight tracks in accordance with the invention so as to smoothly transport a cart with objects carried thereon into the water.

Referring to FIGS. 2, 3 and 4, the pair of moving tracks (30) are able to be mounted on top of the pair of straight tracks (201) of the body (20) and secured therewith by the rotational movement of the axle (23), which causes the stepped face (241) of the lock (24) to engage the cutout (321) of the weight (32). To facilitate the rotational movement of the axle (23), a panel (25) pivotally connected with one of the connection plates (22) and having one end of the axle (23) securely connected therewith and a knob (251) movable thereon is provided to the locking assembly and at least two locking holes (221) are defined in the connection plate (22) such that the axle (23) is the apex of a 90° angle with the two locking holes (221). The knob (251) has a shaft (252) securely mounted thereon that can be selectively inserted into one of the locking holes (221) and a spring (253) mounted around the shaft (252) to provide a force on the knob (251) to hold the shaft (252) in one of the locking holes (221). With such an arrangement, a user is able to pull the knob (251) together with the shaft (252) out of one of the locking holes (221) and rotate the panel (25) about the axle (23) as the center of the rotational movement, thus the axle (23) is rotated.

Figure 5:
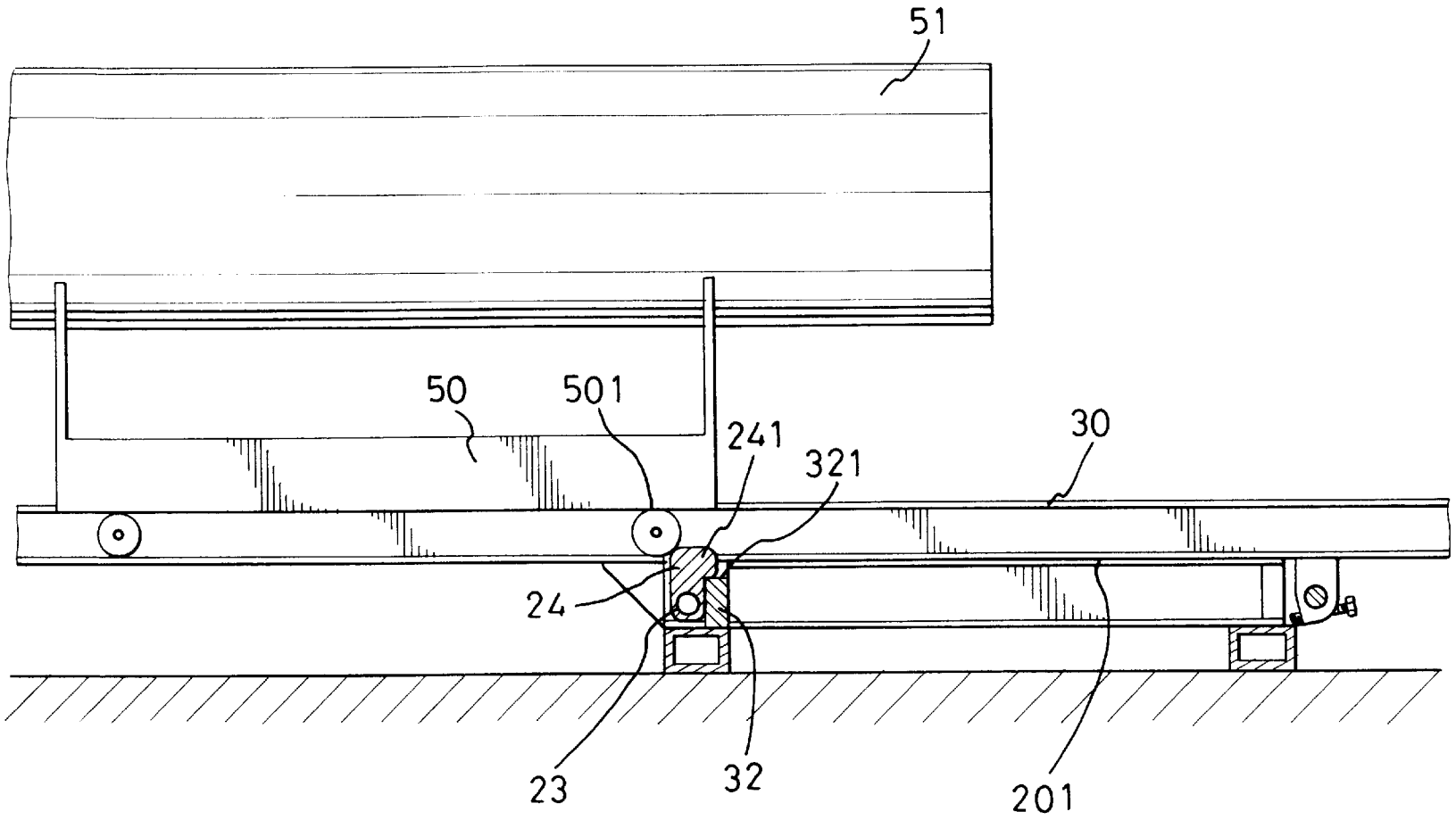
FIG. 5 is a plan view showing that the locking assembly in accordance with the invention is able to limit the movement of the cart so that the safety of the push cart and the object carried on the push cart are ensured.
Figure 6:
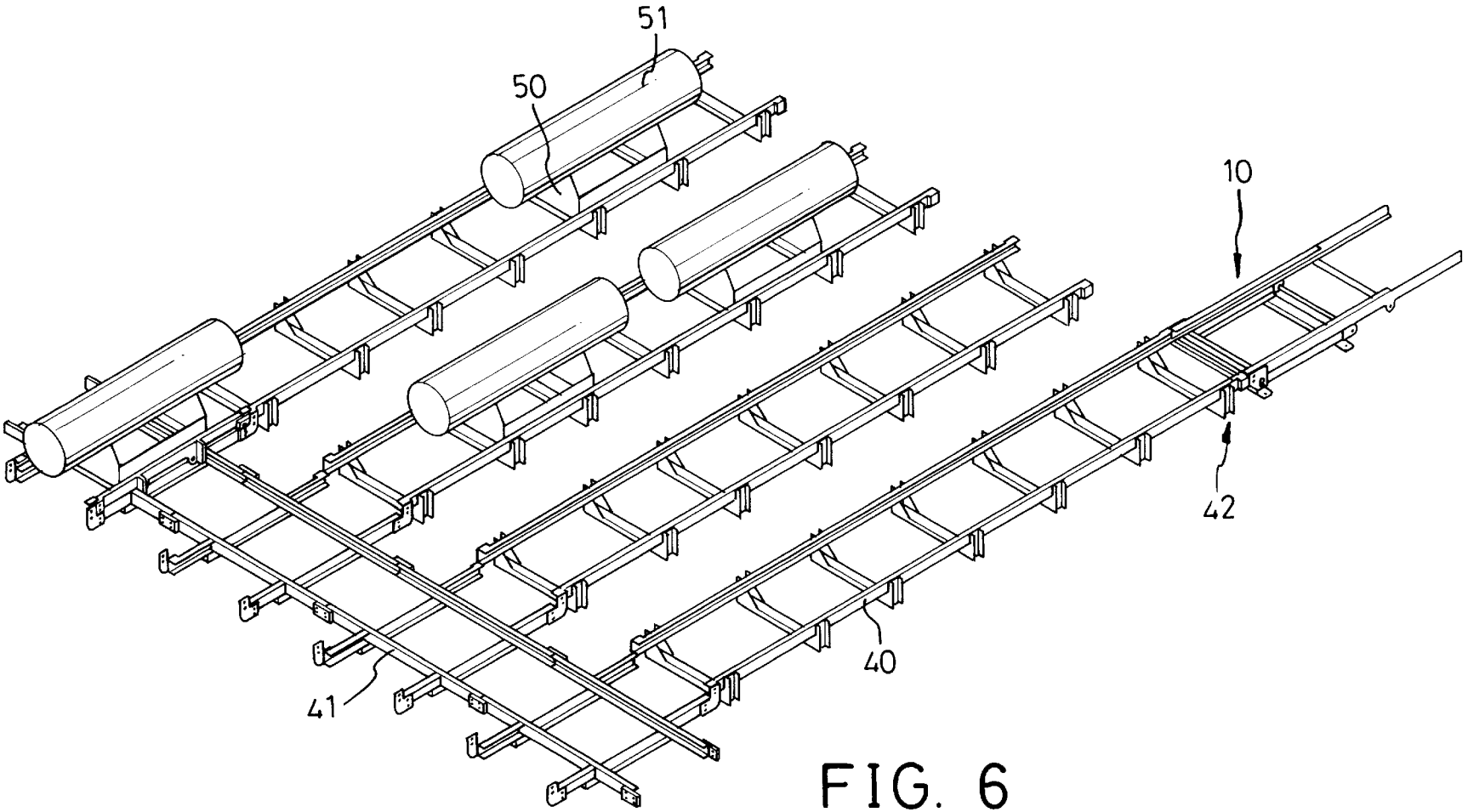
FIG. 6 PRIOR ART
FIG. 6 is a schematic view showing a conventional method of jettisoning an object on a cart into the water.
Figure 7:
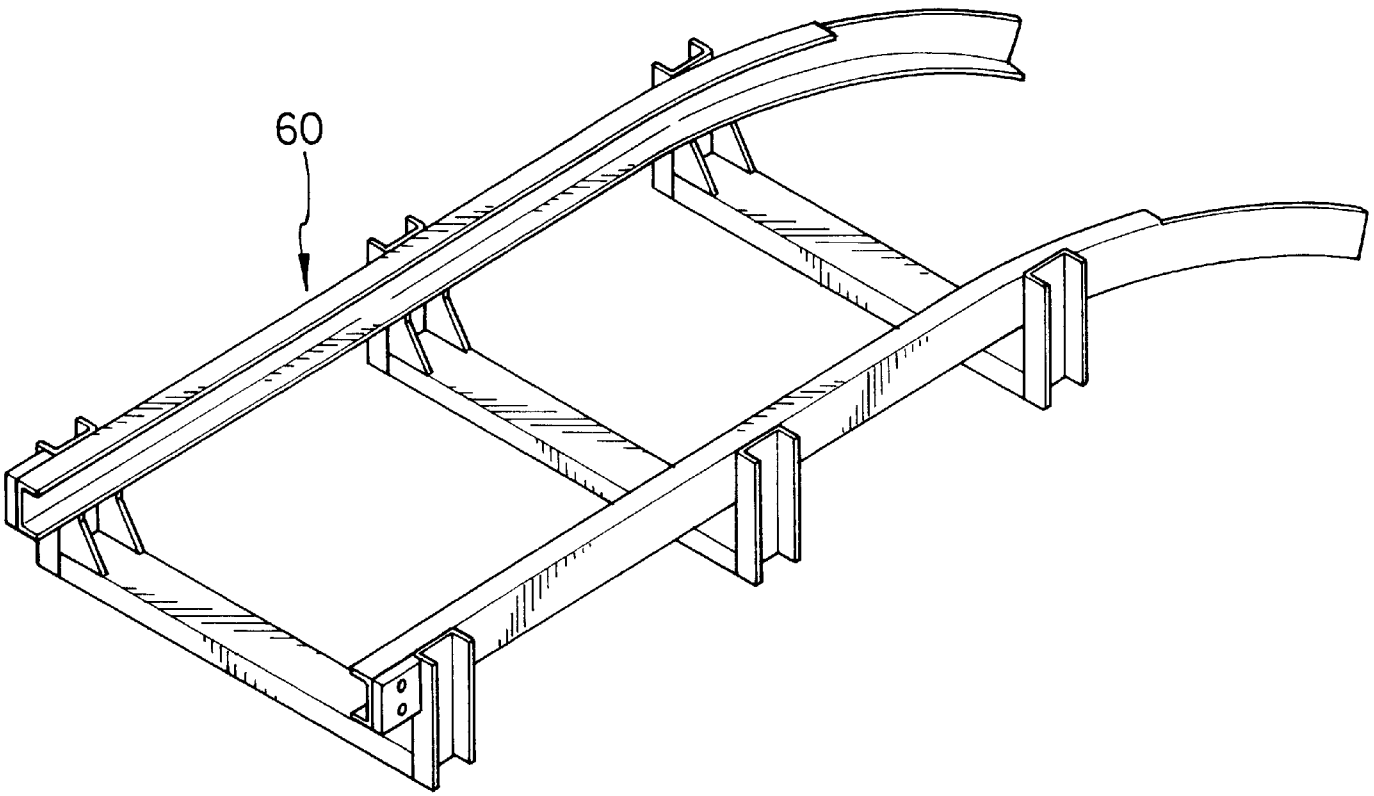
FIG. 7 PRIOR ART
FIG. 7 is a perspective view showing a pair of arcuate tracks used at the end of the conventional tracks to place an object into the water.

Referring to FIGS. 4 and 5, when the user pivots the knob (251), the lock (24) mounted on the axle (23) will rotate accordingly, such that the stepped face (241) will engage or disengage from the cutout (321) of the weight (32) to secure or release the moving tracks (30). When the knob (251) is pulled from one of the pivot holes (221) and rotated in a counterclockwise direction, the stepped face (241) of the lock (24) will release the cutout (321) of the weight (32), so that the moving tracks (30) are able to pivot with respect to the body (20). Before releasing of the lock (24) from the weight (32), the lock (24) in the locking position is also in the way the wheel (501) of the cart (50). Therefore, the cart (50) with the object (51) thereon can be prevented from accidentally moving into the jettisoning position. After the lock (24) is disengaged from the weight (32), the moving tracks (30) are pivotal with respect to the body (20) by the pivotal connection between the pivot seats (21) and the ears (34). When the moving tracks (30) pivot, due to the resistance from the weight (32), the cart (50) together with the object (51) will not be able to slide along the tracks (30) quickly, but slowly, so that neither the operator nor the object (51) will be hurt or damaged Furthermore, referring to FIGS. 1 and 4, when the moving tracks (30) pivot, the under face of the moving tracks (30) will contact an adjusting screw (35) threadingly mounted on the joint of the pivot seat (21) and the ear (34). When the under face of the moving tracks (30) contacts the adjusting screw (35), the jettisoning angle of the moving tracks (30) is limited. However, due to the variations of the sizes and weights of the object (51), the jettisoning angle of the moving tracks (30) has to be adjusted so as to be adapted to the variations of the objects (51). Therefore, the operator is able to change the exposed length of the adjusting screw (35) by screwing the adjusting screw (35) in or out from the joint of the pivot seat (21) and the ear (34). When the length of the adjusting screw (35) is adjusted, the jettisoning angle for the object (51) is changed, such that the operator is able to select a suitable jettisoning angle to jettison the object (51) into the water.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. It should also be noted that those skilled in the art are able to make amendment, alterations and changes according to the detailed description of the preferred embodiment. However, those alternations, changes and\or amendments should also be included in the principle of the invention and claimed in the appended claims.

What is claimed is:

1. A device for jettisoning object into the water from a vessel comprising:

body (20) having a pair of parallel straight tracks (201) each provided with a pivot seat (21) and a connection plate (22) respectively mounted on opposite ends thereof;

a locking assembly pivotally mounted on the body (20); and having an axle rotationally connected between one of the connection plate and one of the opposed straight tracks and two opposed locks securely mounted on different ends of the axle;

a pair of moving tracks (30) pivotally connected with the pair of straight tracks (201) of the body (20) and selectively and securely connected with the locking assembly and having a pair of opposed ears (34) respectively formed on the under side of each of the moving tracks (30).

2. The device as claimed in claim 1, wherein the locking assembly comprises said axle (23) one end of which is rotationally connected with one of the connection plate (22) and the other end is rotationally connected with one of the straight tracks (20) and having at least one lock (24) securely mounted thereon and provided with a stepped face (241) thereon, wherein the pair of moving tracks (30) has a weight (32) securely connected therebetween for providing a counterbalance to the moving tracks (30) when pivoted and a cutout (321) defined therein corresponding to the stepped face (241) of the lock (24);

whereby the lock (24) is able to lock/release the pair of moving tracks (30) by the engagement/disengagement of the stepped face (241) of the lock (24) with the cutout (321) of the weight (32).

3. The device as claimed in claim 2, wherein a panel (25) having one end of the axle (23) securely connected therewith and a knob (251) movably mounted thereon is rotationally connected with one of the connection plates (22).

4. The device as claimed in claim 3, wherein one of the connection plate (22) has at least two locking holes (221) defined therein and the knob (251) has a shaft (252) selectively inserted into one of the locking holes (221).

5. The device as claimed in claim 4, wherein the two locking holes (221) are spaced 90 degrees apart with respect to the axle (23).

6. The device as claimed in claim 4, wherein the shaft (252) has a spring mounted therearound for providing a force on the knob (251) so as to maintain the shaft (252) in one of the locking holes (221).

7. The device as claim 1, wherein the pair of straight tracks (201) is pivotally connected with the pair of moving tracks (30) by a pin (31) pivotally and respectively inserted through the ear (34) and the pivot seat (21).

8. The device as claimed in claim 7, wherein an adjusting screw (35) is threadingly mounted on the joint of the ear (34) and the pivot seat (21) to contact an end of the body (20).

* * * * *